United States Patent [19]

Martin

[11] 4,344,116

[45] Aug. 10, 1982

[54] FLAT FACE NIGHT LIGHT

[75] Inventor: Robert L. Martin, Coventry, R.I.

[73] Assignee: General Electric Company, New York, N.Y.

[21] Appl. No.: 937,910

[22] Filed: Aug. 30, 1978

[51] Int. Cl.[3] ..... H01R 33/00

[52] U.S. Cl. ..... 362/226

[58] Field of Search ..... 362/226

[56] References Cited

U.S. PATENT DOCUMENTS

| | | | |
|---|---|---|---|
| 3,187,172 | 6/1965 | Knapp et al. | 362/226 |
| 3,196,266 | 7/1965 | Grosser | 362/226 |
| 3,203,126 | 8/1965 | Eliot | 362/226 |
| 3,400,262 | 9/1968 | Newman et al. | 362/226 |
| 3,706,004 | 12/1972 | Schwartz | 362/226 |
| 3,735,118 | 5/1973 | Martin et al. | 362/226 |
| 3,818,212 | 6/1974 | Rochford et al. | 362/226 |
| 3,818,213 | 6/1974 | Rochford et al. | 362/226 |

*Primary Examiner*—Monroe H. Hayes

*Attorney, Agent, or Firm*—Paul E. Rochford; Walter C. Bernkopf

[57] ABSTRACT

A night light is provided having a generally disc configuration. The disc is made up of a near shallow dished cylindrical housing and a slightly smaller shallow dished cylindrical lens. The lens fits within the housing and is latched to be retained in the housing in rotatable relation to the housing. Decorative configuration and decoration is applied to the exposed lens surface. The lens protrudes from the housing sufficiently to permit finger grip for rotation. Power blades are mounted through the rear wall of the housing and are fixed in the wall to permit the night light to be supported from the blades. A source of light is electrically connected to the blades.

10 Claims, 12 Drawing Figures

FLAT FACE NIGHT LIGHT

BACKGROUND OF THE INVENTION

The present invention relates generally to an electric night light article; more particularly it relates to a disc shaped night light with a rotatable decorative face and with rearwardly extending blades mounted directly into the rear of the disc housing.

The use of night lights in household applications is very well known. Numerous night lights have been manufactured and produced over a number of years and have gained wide acceptance with the purchasing public for use in providing a low level of lighting in homes, apartments, and other buildings.

Night lights have generally been of two varieties. A first includes an incandescent heat-producing bulb and the second includes a cool source of light, such as a luminescent panel or a glow lamp. The product provided pursuant to this invention is primarily useful with a cool source of light, such as a glow lamp.

There are numerous prior art products which employ a cool variety of light sources and some patents which have issued covering products of this sort include U.S. Pat. Nos. 3,819,923, 3,818,213, 3,818,212, 3,735,118, which patents are assigned to the same assignee as the subject application. In addition, in the incandescent night light category, the U.S. Pat. Nos. 3,694,607 and 3,457,383 and numerous others are included.

OBJECTS OF THE INVENTION

Accordingly, one object of the present invention is to provide a safe reliable low-cost night light product.

Another object is to provide a night light having great ease of assembly of the parts thereof.

A further object is to provide a night light the assembly of which does not require secondary operations on the parts or materials thereof.

A further object is to provide a night light of simple construction having a rotatable decorative face to permit alignment of the decorative material relative to the receptacle in which the night light is employed.

Another object is to provide a night light which is subject to automated assembly.

Still another object is to provide a night light which is simply assembled but which is not subject to simple disassembly.

Other objects and advantages of the present invention will be pointed out and in part explained in the description which follows.

BRIEF SUMMARY OF THE INVENTION

A generally disc shaped night light is provided having a substantial diameter in relation to its thickness. The disc shape results from combining a rear cylindrical shallow dished housing with a front cylindrical shallow dished lens of diameter slightly smaller than that of the housing. Latching surfaces are integrally formed on the internal cylindrical surface of the housing and on the external cylindrical surface of the lens. Pressing the lens into the housing latches the lens in the housing in notatable relation. Decorative forms and material on the lens surface may be oriented by rotation of the internal lens.

Power blades extend through the rear face of the housing and the blades are fixed in the face to permit the night light to be supported by the blades. A light source is electrically connected to the inner ends of the blades and illuminated decorative material formed in or deposited on the lens surface from the lens interior.

BRIEF DESCRIPTION OF THE DRAWINGS

The present invention will be understood with greater clarity by reference to the accompanying drawings in which.

DETAILED DESCRIPTION OF A PREFERRED EMBODIMENT

Figure 1:
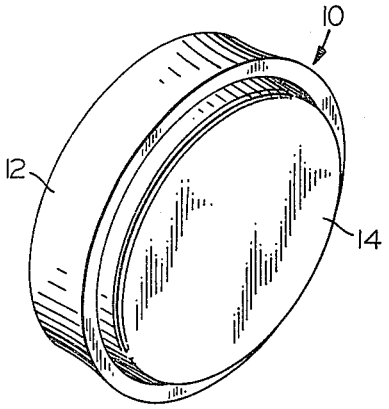
FIG. 1 is a perspective view of a night light as provided pursuant to this invention.
Figure 2:
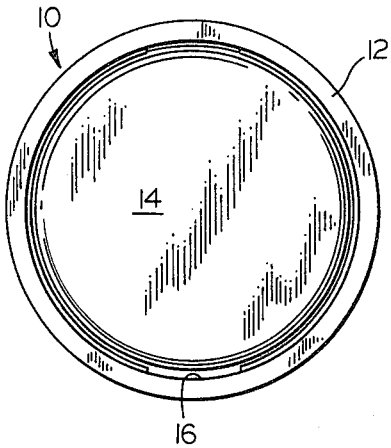
FIG. 2 is a front elevational view of the night light of FIG. 1.

Referring first to the FIGURES, a night light 10 is illustrated in FIG. 1 in perspective view and is seen to have a generally disc-like configuration with a rear housing 12 and a forward lens 14 mounted in open face of the housing 12.

Figure 3:
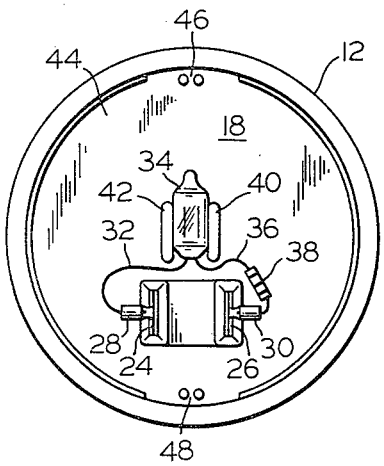
FIG. 3 is a front elevational view of the night light of FIG. 2 with the front lens removed.
Figure 4:
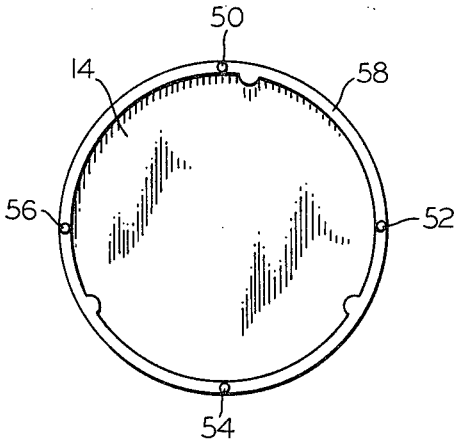
FIG. 4 is a rear elevational view, relative to FIG. 2, of the lens removed from the article of FIG. 3 to expose the interior thereof.
Figure 6:
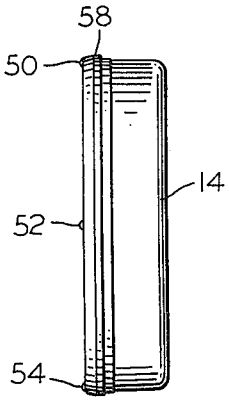
FIG. 6 is a side elevational view of the night light lens of FIG. 4.
Figure 10:
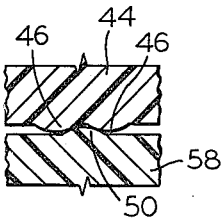
FIG. 10 is a detailed sectional view of the interlocking protrusions of the housing and lens which provide orientation for the lens.

As illustrated in FIG. 3, which is a front elevation of the housing 12 with the lens removed, the housing 12 has a generally dish-like shape and has an open front face 16 and enclosed rear face 18. There is formed integrally in the closed rear face the blade openings 20 and 22 having the blade members 24 and 26 mounted respectively therein. Blade 24 has a crimped contact 28 and blade 26 has a crimped contact 30 formed integrally at the end thereof. Crimped within contact 28 is the conductor 32 leading to glow lamp 34. Extending from crimp contact 30 is the conductor 36 also leading to glow lamp 40 and including the resistor 38 in series in the conductor. Two guides 40 and 42 on either side of the glow lamp 34 are formed integrally on the inner surface of the closed face 44 of housing 12. The set of two protuberances 46 are also formed on the inner side of the closed face 44 as is the set of two oppositely disposed protuberances 48. These two sets of protuberances 46 and 48 mate with the four bosses 50, 52, 54 and 56 which are illustrated in FIGS. 4 and 6 and which are formed on the outer edge 58 of the lens 14. The boss and protuberance pair form a positioning guide by which the position of the lens relative to the housing may be set with some reliability. An illustration of their relationship is given in the sectional view of FIG. 10 wherein the pair of protuberances 46 is shown to be formed integrally with the back face 44 of the housing and the boss 50 is illustrated as being formed integrally with the edge 58 of the lens. The use of the boss and protuberance pair makes the alignment of the lens relative to the housing very convenient and reliable in that the turning of the lens relative to the housing gives a definite feel or touch at the point where the lens boss 50 is located between the pair 46 of protruberances.

Figure 5:
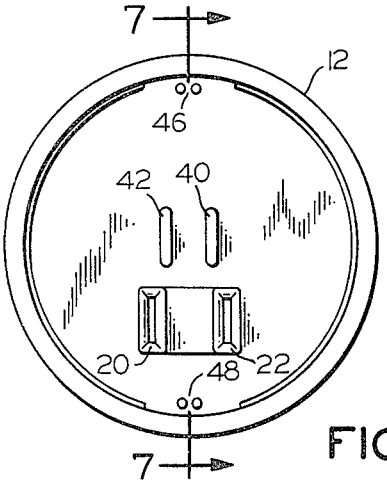
FIG. 5 is a front elevational view of the housing for the night light with the electrical parts omitted.
Figure 7:
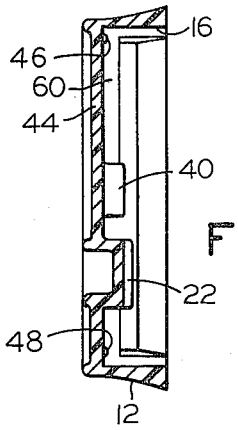
FIG. 7 is a vertical sectional view taken along the line 7—7 of FIG. 5 of the night light housing.

Referring next to FIG. 7 this is a sectional view taken along the line 7—7 of FIG. 5. Both the articles of FIG. 5 and FIG. 7 are illustrated without the electrical power blades and other electrical parts assembled.

As will be evident from a further consideration of FIGS. 11 and 12 below the outer surface or edge 58 of the lens as viewed in FIG. 6 and an inner surface 60 of the housing viewed in FIG. 7 constitute a pair of conforming surfaces which permit the lens to be inserted at its outer edge into the housing and to be snapped in place therein to resist removal. In addition, once it is snapped in place the outer edge 58 of the lens and the inner edge 60 of the housing are spaced to permit rotation of the lens relative to the housing. It is important to note that no secondary operation on the unit is necessary in order to achieve this desirable result. Further, the rotation and the positioning of the lens by its rotation within the housing is aided by the sets of protuberances and the bosses which are formed integrally with the housing and the lens at the confronting surfaces. Considering next the FIGS. 11 and 12, in FIG. 11 an enlarged sectional view of one edge of the housing together with an enlarged sectional view of one edge of the lens are illustrated poised in pre-assembled position. In FIG. 12 the same two parts are illustrated in the assembled form with the housing shown in section but with the lens not shown in section.

Figure 11:
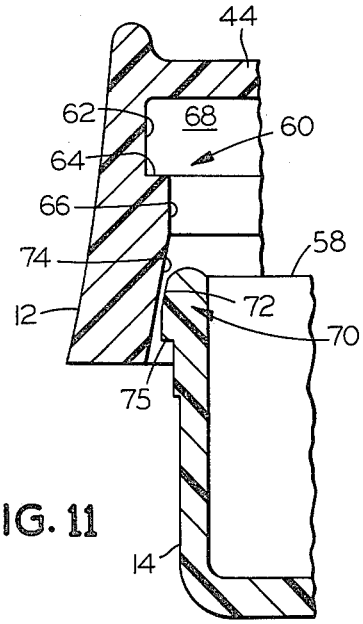
FIG. 11 is a detailed sectional view of the edge of the housing shown together with the edge of the lens with the lens poised for mounting into the housing.
Figure 12:
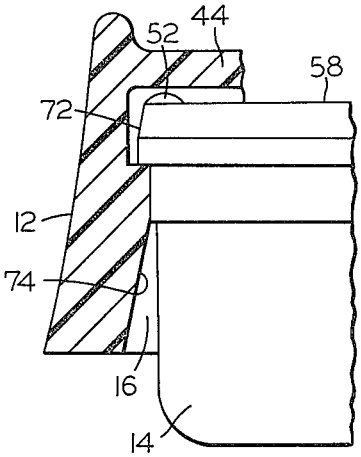
FIG. 12 is a view similar to that of FIG. 11 but illustrating the lens mounted within the housing.

Considering first FIG. 11, the edge of the housing has side wall 12 and a back wall 44. The interlocking surface 60 of the housing includes an outer side wall surface 62 formed as a part of an undercut well 68. It includes the inner side wall surface 66 and it also includes a shoulder 64 between the inner side wall surface 66 and the surface 62. The shoulder 64 constitutes an inner ledge extending around the perimeter of the inner surface of the housing and it is on this ledge that the latching surface of the lens can rest and be held in place.

The lens itself has an inner edge 58 extending around perimeter of the lens. It has a beveled surface 72 which matches a beveled surface 74 on the inner surface of the housing 12. The interaction of the two beveled surfaces as the lens is pushed into the housing permits the outer surface of the lens to ride up and over the inner surface 66 of housing and to reach the inner well 68. At this point the latching surface 74 of the lens becomes seated on the ledge 64 of the housing and the collar 76 of the lens rides on the inner surface 66 of the housing so that a good mating of the two confronting surfaces 66 and 76 is accomplished. Withdrawal of the lens from the housing is prevented by the latching of the latch surface 74 over the shoulder or ledge surface 64. The boss 52 can interact with the sets of protuberances 46 and 48 to give the lens a fixed position relative to the housing. It will be noted that there is no secondary operation which is needed in the assembly of the product to a final form. As soon as the assembly is accomplished the product is in its final and usable state. Accordingly the assembly of the product from the two molded parts namely the housing and the lens is simply a matter of pressing the lens into the housing to the point where latching is achieved and from that point on the rotation and operation of the housing and lens relative to each other is made feasible without further operations on the units or modification of the structure thereof.

Figure 8:
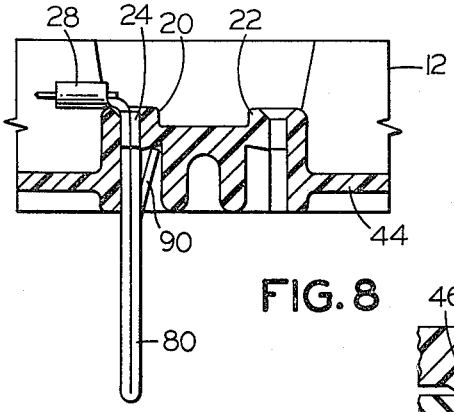
FIG. 8 is a detailed sectional view of the central portion of the night light housing illustrating one power blade mounted in place.
Figure 9:
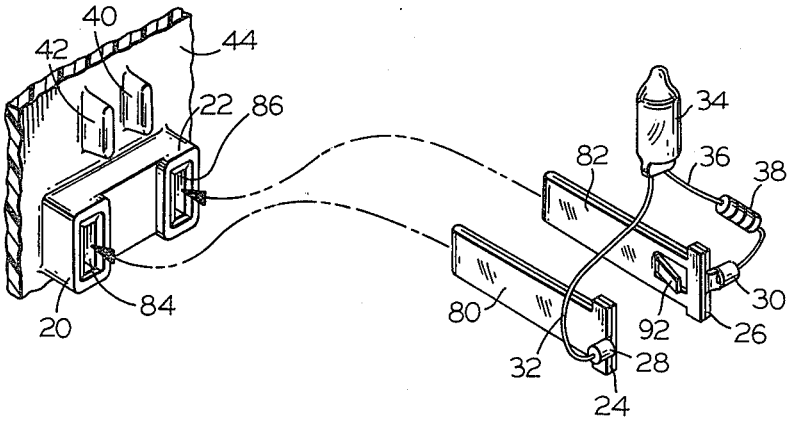
FIG. 9 is an exploded view in part in section of the central portion of the housing and the electrical parts, which are mounted in the central portion, shown poised for entry into the housing.

Essentially the same simplicity in fabrication is accomplished with reference to the electrical parts of the night light of this invention. Referring for this purpose to the FIGURES and particularly FIGS. 8 and 9 which illustrate the electrical portions, the assembly is accomplished again by pushing the electrical components into place in the housing. In this regard with reference to FIG. 9, the subassembly of electrical parts is illustrated at the right side of the figure poised for delivery to and entry into the conforming parts of the housing. Accordingly the bulb 34 is connected by the two wires 32 and 36 through a resistor conductor 36 to the crimp sleeves 28 and 30 of the blade contacts 80 and 82. The blades 80 and 82 have the rear portions 24 and 26 designed for entry into the blade ports 84 and 86 respectively of the back 44 of the housing. The integrally molded blade sleeves 20 and 22 receive the blades in their respective blade ports 84 and 86. A blade latch 92 on blade 82 and a blade latch 90 on blade 80 fit into the blade sleeves 22 and 20 respectively and permit the blade assembly to be pushed in place and then to be held in place due to the spring and latching action of the blade latches 90 and 92.

The bulb 34 is nested between the bulb guides 40 and 42. The bulb guides are integrally formed with the back 44 of housing 12.

Accordingly, by the formation of the simple electrical blade, resistor and lamp assembly, and the formation of a housing to receive this assembly, the electrical parts are assembled to the housing by a simple insertion operation. Once assembled they are held very well in place without fear of the wire shorting because of the secure way in which the parts are held including the fact that the wire crimps 28 and 30 face in opposite direction as they extend from the blades and also the fact that the bulb itself is nested between the bulb guides 40 and 42.

Accordingly, the assembly of the electrical parts to the night light is a very economical and simple operation. Further, the assembly of the lens to the housing once the electrical parts are in place is an economic and simple operation.

From this it is evident that a low cost, easily assembled, reliable night light product is formed by simple fabrication techniques based on the novel design of the elements of the article and the inter-relation of the parts based on the novel design.

It will be understood that certain modifications can be made in the elements of the structure without departing from spirit and scope of the invention and that the foregoing specification is not limited to the express form of parts which are illustratively given but that the scope of the invention is defined by the claims which accompany this application.

What is claimed and sought to be protected by Letters Patent of the United States is the following:

1. A night light comprising a shallow cylindrical dished housing having an open and a closed face, said housing having an internal annular latching ledge, a pair of electric power blades mounted through the closed face of said housing and fixed in said face to permit said housing to be supported by said blades, an electrically powered light source electrically connected to the external ends of said power blades, a shallow cylindrical dished lens, said lens having an open face and a closed face and a diameter slightly smaller than that of said housing to permit the open face of said lens to be nested in the open face of said housing, the lens having an external latching rim of diameter slightly larger than the internal diameter of said latching ledge, and the lens being nested in the housing with the latching ledge latched over the latching rim to prevent removal of said lens.

2. The night light of claim 1 in which the lens is free to be rotated in the housing.

3. The night light of claim 1 in which the closed face of the lens protrudes out of the open face of the housing to permit finger tip grip thereof for rotation.

4. The night light of claim 1 in which protrusions are spaced around the external perimeter of the lens adjacent the open face thereof and matching detents are spread around the internal surface of the closed face of the housing, to define positions of fixed angular orientation of the lens relative to the housing.

5. The night light of claim 1 in which the electric light source is a glow lamp.

6. The night light of claim 1 in which the closed face of the lens bears decorative images.

7. The night light of claim 1 in which the closed face of the lens is formed to give the face a decorative appearance.

8. The night light of claim 7 in which the formed face of the lens bears decorative matter to enhance the appearance thereof.

9. The night light of claim 7 in which the light is behind the formed portion of the closed face of the lens to give enhanced decorative effects thereto.

10. The night light of claim 1 in which the outer surface of the cylindrical portion of the housing is tapered toward the closed face to provide a finger grip surface for ease of handling the night light.

* * * * *